US012768561B2

(12) United States Patent
Hwang et al.

(10) Patent No.: US 12,768,561 B2
(45) Date of Patent: Oct. 20, 2026

(54) AIR CONDITIONER AND METHOD OF CONTROLLING AIR CONDITIONER

(71) Applicant: KYUNGDONG NAVIEN CO., LTD., Pyeongtaek-si (KR)

(72) Inventors: In Soo Hwang, Seoul (KR); Gyoo Ha Jung, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 96 days.

(21) Appl. No.: 18/812,509

(22) Filed: Aug. 22, 2024

(65) Prior Publication Data

US 2025/0075934 A1 Mar. 6, 2025

(30) Foreign Application Priority Data

Aug. 31, 2023 (KR) ..... 10-2023-0115469

(51) Int. Cl.

| | |
|---|---|
| ***F24F 11/84*** | (2018.01) |
| ***F24F 11/41*** | (2018.01) |
| ***F24F 11/67*** | (2018.01) |
| *F24F 110/12* | (2018.01) |

(52) U.S. Cl.

CPC ..... *F24F 11/84* (2018.01); *F24F 11/41* (2018.01); *F24F 11/67* (2018.01); *F24F 2110/12* (2018.01)

(58) Field of Classification Search

CPC .. F24F 11/84; F24F 11/41; F24F 11/67; F24F 2110/12; F24F 2339/041

See application file for complete search history.

(56) References Cited

U.S. PATENT DOCUMENTS 5,605,053 A * 2/1997 Otori ..... F24F 11/56 62/181
2005/0252226 A1* 11/2005 Seefeldt ..... F25B 13/00 62/238.7

(Continued)

FOREIGN PATENT DOCUMENTS

CN 108189640 A * 6/2018 ..... B60H 1/00642
JP S 55143398 A 11/1980

(Continued)

OTHER PUBLICATIONS

CN-108189640-A Translation (Year: 2018).*
KR101415703 Translation (Year: 2012).*

*Primary Examiner* — David J Teitelbaum
(74) *Attorney, Agent, or Firm* — Dority & Manning, PA

(57) ABSTRACT

Disclosed are an air conditioner and a method of controlling the same. The air conditioner includes a first heat exchanger disposed in an indoor space, a second heat exchanger disposed in an outdoor space, a water injection module disposed to be adjacent to the second heat exchanger, the water injection module including a flow adjustment valve adjusting supply of water to the second heat exchanger, a fluid tube connected to the first heat exchanger and the second heat exchanger, a compressor and an expansion valve disposed on the fluid tube, a flow path switching valve changing a path of fluid discharged from the compressor to allow the fluid to flow toward one of the first heat exchanger and the second heat exchanger, a processor connected to the flow adjustment valve and the flow path switching valve, and a storage unit connected to the processor.

8 Claims, 5 Drawing Sheets

(56) References Cited

U.S. PATENT DOCUMENTS

| | | | | |
|---|---|---|---|---|
| 2011/0277495 | A1* | 11/2011 | Lee | F24F 1/0057 62/428 |
| 2021/0348794 | A1* | 11/2021 | Stewart | F24F 11/54 |
| 2023/0101537 | A1 | 3/2023 | Lee et al. | |

FOREIGN PATENT DOCUMENTS

| | | | | |
|---|---|---|---|---|
| JP | 2015010766 | A | 1/2015 | |
| KR | 20090035555 | A | 4/2009 | |
| KR | 101415703 | B1 * | 7/2014 | F25B 41/37 |
| KR | 20150006664 | A | 1/2015 | |
| KR | 10-2019-0006781 | A | 1/2019 | |
| KR | 10-2021-0070921 | A | 6/2021 | |
| KR | 10-2021-0108242 | A | 9/2021 | |
| KR | 10-2022-0074734 | A | 6/2022 | |

* cited by examiner

AIR CONDITIONER AND METHOD OF CONTROLLING AIR CONDITIONER

CROSS-REFERENCE TO RELATED APPLICATION(S)

This application claims benefit of priority to Korean Patent Application No. 10-2023-0115469 filed on Aug. 31, 2023 in the Korean Intellectual Property Office, the disclosure of which is incorporated herein by reference in its entirety.

BACKGROUND

1. Field

The present disclosure relates to an air conditioner and a method of controlling the air conditioner.

2. Description of Related Art

An air conditioner may be an apparatus maintaining a comfortable indoor environment by controlling indoor temperature and humidity or ventilating or purifying indoor air depending on user needs. In the related art, a technology for performing indoor heating and cooling operations using a heat pump as an air conditioner is disclosed. Specifically, during the cooling operation using the heat pump, heat may pass through a compressor and may be externally discharged by an outdoor heat exchanger installed in an outdoor space, and indoor heat may be absorbed and vaporized by an indoor heat exchanger, disposed in an indoor space, using a pressure reducing means, such that cooling of the indoor space may be performed. In addition, during the heating operation using the heat pump, a refrigerant, evaporated by the outdoor heat exchanger, may be compressed by the compressor, and the compressed high-temperature, high-pressure refrigerant may be condensed by the indoor heat exchanger, such that heat may be discharged to the indoor space, and heating may be performed on the indoor space. Here, the outdoor heat exchanger may operate as a condenser during the cooling operation and as an evaporator during the heating operation, using an outdoor air heat source.

In the case of such heat pumps, during a heating operation especially in a situation such as extremely low outdoor temperature, a low-temperature refrigerant, introduced through an outdoor heat exchanger, may not sufficiently absorb heat energy from an outdoor space, resulting in frosting in the outdoor heat exchanger. Furthermore, lack of temperature rise of the refrigerant flowing through the outdoor heat exchanger may reduce heating capacity and efficiency. In the case of heat pumps being operated in areas in which a rate of a cooling operation is higher than that of a heating operation due to outdoor temperature that is not low, there is a demand for a technology for improving not only heating performance but also cooling performance.

PRIOR ART DOCUMENT

Patent Document

Patent Document 1: KR10-2021-0108242 A (Sep. 2, 2021)

SUMMARY

An aspect of the present disclosure provides an air conditioner having improved cooling performance while ensuring heating performance, and a method of controlling the same.

According to an aspect of the present disclosure, there is provided an air conditioner including a first heat exchanger disposed in an indoor space, a second heat exchanger disposed in an outdoor space, a water injection module disposed to be adjacent to the second heat exchanger, the water injection module including a flow adjustment valve adjusting supply of water to the second heat exchanger, a fluid tube connected to the first heat exchanger and the second heat exchanger, a compressor and an expansion valve disposed on the fluid tube, a flow path switching valve changing a path of fluid discharged from the compressor to allow the fluid to flow toward one of the first heat exchanger and the second heat exchanger, a processor connected to the flow adjustment valve and the flow path switching valve, and a storage unit connected to the processor. The storage unit may include a program changing a heating mode in which the flow adjustment valve is closed such that the first heat exchanger operates as a condenser and the second heat exchanger operates as an evaporator, and the flow path switching valve performs adjustment to allow the fluid from the compressor to flow toward the first heat exchanger, and a cooling mode in which the flow adjustment valve is opened such that the first heat exchanger operates as the evaporator and the second heat exchanger operates as the condenser, and the flow path switching valve performs adjustment to allow the fluid from the compressor to flow toward the second heat exchanger.

The air conditioner may further include an outdoor fan forming a flow of air passing through the second heat exchanger, the outdoor fan connected to the processor. The program may be set such that a minimum air volume of the outdoor fan in the heating mode is greater than a minimum air volume of the outdoor fan in the cooling mode.

The air conditioner may further include a drive motor connected to the second heat exchanger, the drive motor driven such that the second heat exchanger is adjustable in a predetermined angle range relative to a vertical direction.

The second heat exchanger may be disposed to be inclined at a predetermined angle relative to the vertical direction.

According to another aspect of the present disclosure, there is provided a method of controlling an air conditioner including a first heat exchanger disposed in an indoor space, a second heat exchanger disposed in an outdoor space, a water injection module disposed to be adjacent to the second heat exchanger, the water injection module injecting water to the second heat exchanger, a fluid tube connected to the first heat exchanger and the second heat exchanger, a compressor and an expansion valve disposed on the fluid tube, and a flow path switching valve changing a path of fluid discharged from the compressor to allow the fluid to flow toward one of the first heat exchanger and the second heat exchanger, the method including controlling the air conditioner, depending on an automatic operation or an input condition of an input unit, to perform a heating mode in which the first heat exchanger operates as a condenser, the second heat exchanger operates as an evaporator without water injection, and fluid from the compressor flows toward the first heat exchanger, or a cooling mode in which the first heat exchanger operates as the evaporator, the second heat exchanger operates as the condenser while injecting water, and the fluid from the compressor flow toward the second heat exchanger.

The air conditioner may be controlled such that a minimum air volume of an outdoor fan, forming a flow of air passing through the second heat exchanger, in the heating mode, is greater than a minimum air volume of the outdoor fan in the cooling mode.

When an indoor temperature reaches a target cooling temperature in the cooling mode, an amount of water injected to the second heat exchanger and an air volume of an outdoor fan, forming a flow of air passing through the second heat exchanger, may be controlled to maintain the target cooling temperature.

When an indoor temperature reaches a target heating temperature in the heating mode, an air volume of an outdoor fan, forming a flow of air passing through the second heat exchanger, may be controlled to maintain the target heating temperature.

When an outdoor temperature is higher than a preset temperature in the cooling mode, an average flow rate of air passing through the second heat exchanger may be increased and controlled to be lower than an average flow rate of air passing through the second heat exchanger in the heating mode.

When frosting occurs in the second heat exchanger in the heating mode, the air conditioner may be controlled such that a defrost mode in which an operation of an outdoor fan, forming a flow of air passing through the second heat exchanger, is stopped, and the first heat exchanger operates as the evaporator and the second heat exchanger operates as the condenser without water injection is performed for a predetermined period of time.

In an air conditioner and a method of controlling the same according to example embodiments of the present disclosure, heating performance may be ensured using a second heat exchanger, and fluid may be more efficiently condensed by the second heat exchanger through water injection in a cooling mode, thereby effectively improving cooling efficiency.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Hereinafter, example embodiments of the present disclosure will be described in detail with reference to the drawings. However, the spirit of the present disclosure is not limited to the presented example embodiments. For example, a person skilled in the art, and understanding the spirit of the present disclosure, would be able to propose other example embodiments included within the scope of the present disclosure through the addition, change, or deletion of components. All such variations are also within the scope of the present disclosure.

Through the specification, when a component, such as a layer, region, or substrate, is described as being "on," "connected to," or "coupled to" another component, it may be directly "on," "connected to," or "coupled to" the other component, or there may be one or more other components intervening therebetween. In contrast, when a component is described as being "directly on," "directly connected to," or "directly coupled to" another component, there can be no other components intervening therebetween.

Figure 1:
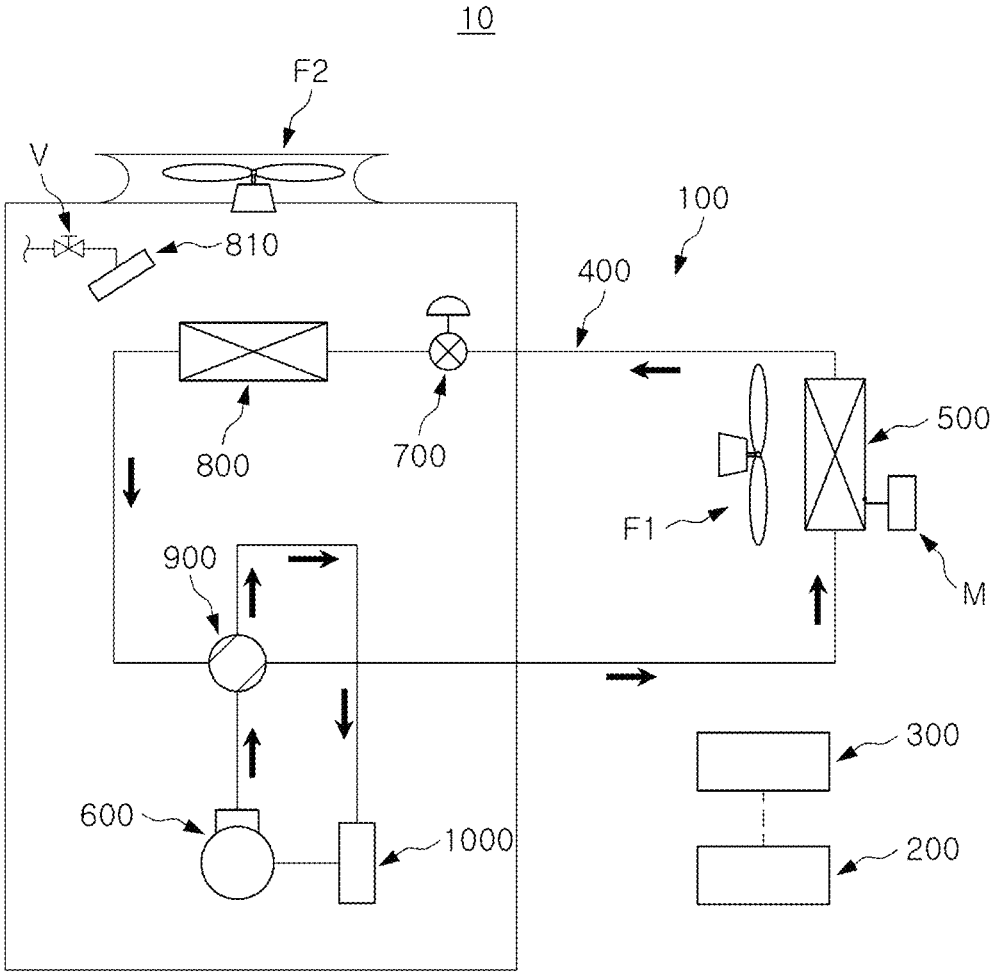
FIG. 1 is a schematic diagram illustrating an operation process in a heating mode of an air conditioner according to an example embodiment of the present disclosure.
Figure 2:
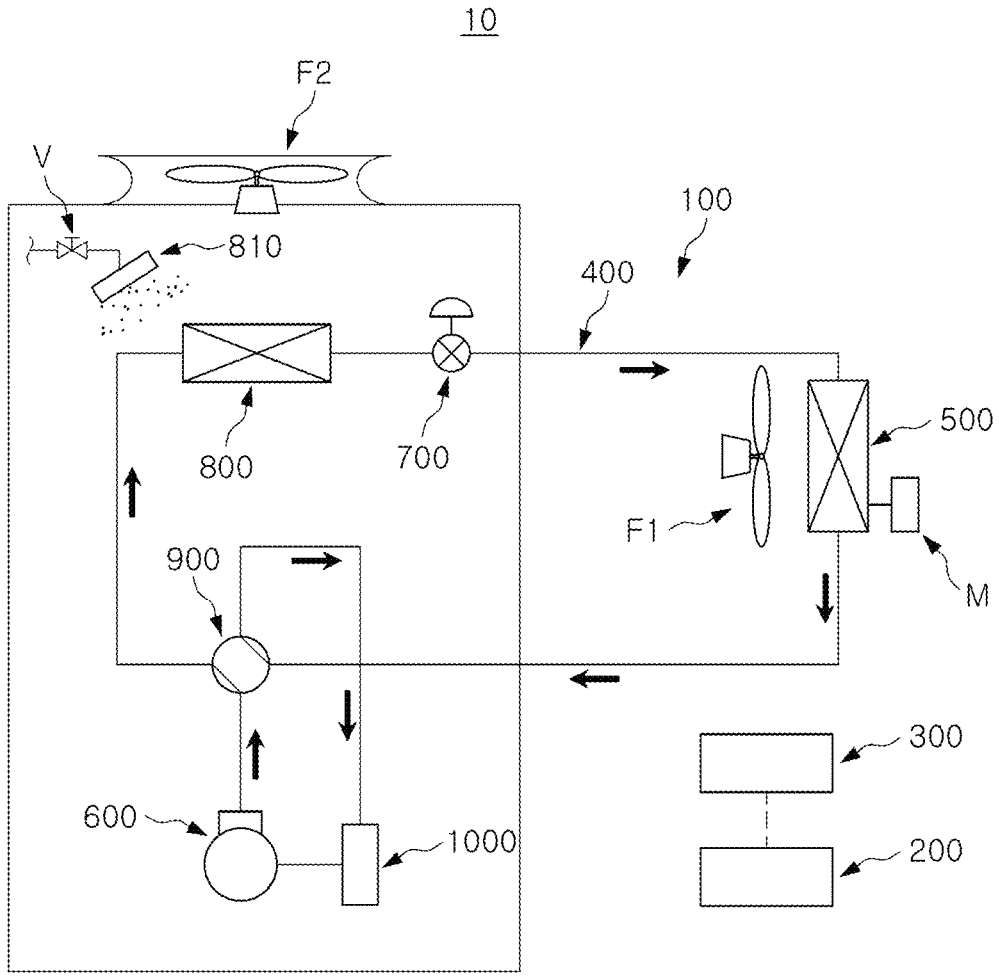
FIG. 2 is a schematic diagram illustrating an operation process in a cooling mode of an air conditioner according to an example embodiment of the present disclosure.
Figure 3:
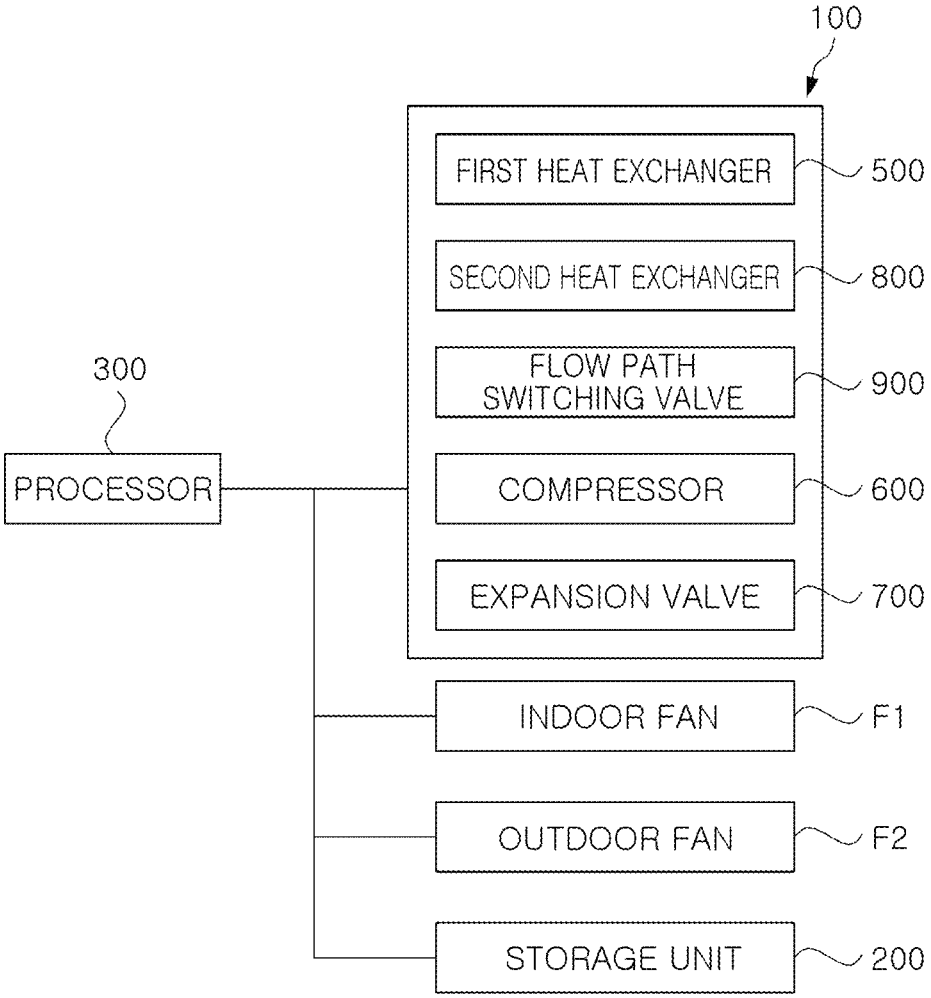
FIG. 3 is an exemplary diagram illustrating a connection relationship between a processor and other components according to an example embodiment of the present disclosure.
Figure 4:
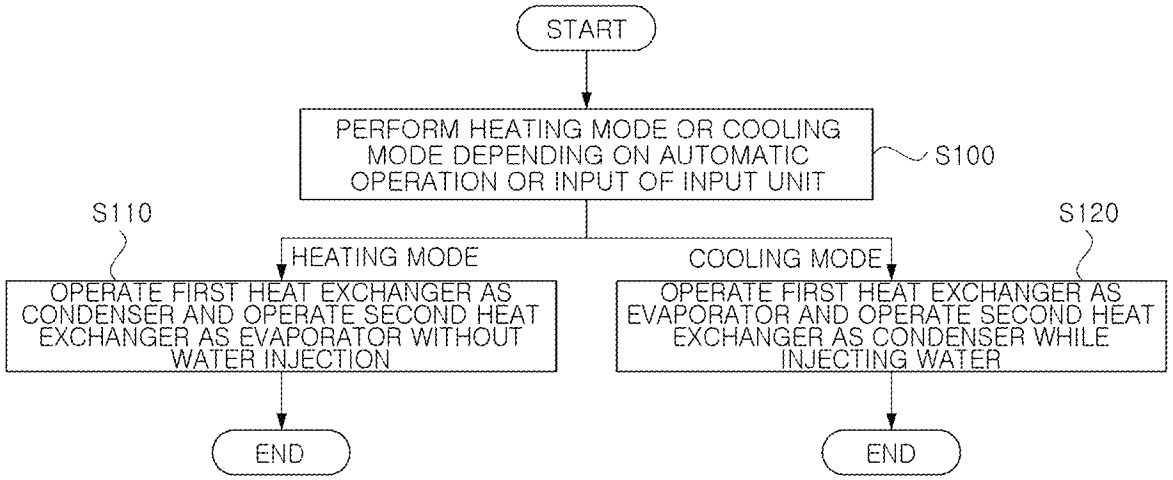
FIG. 4 is a flowchart illustrating a control process of an air conditioner according to an example embodiment of the present disclosure.
Figure 5:
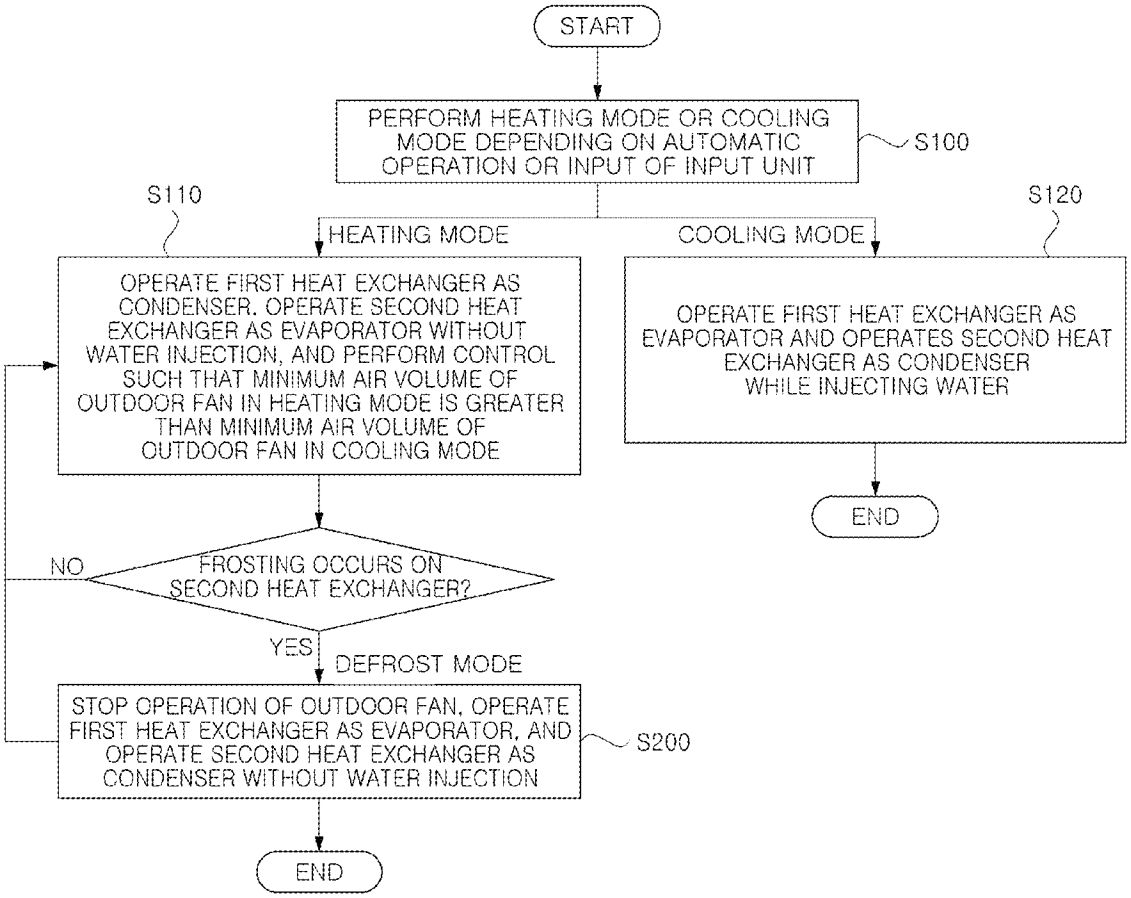
FIG. 5 is another flowchart illustrating a control process of an air conditioner according to an example embodiment of the present disclosure.

FIG. 1 is a schematic diagram illustrating an operation process in a heating mode of an air conditioner according to an example embodiment of the present disclosure. FIG. 2 is a schematic diagram illustrating an operation process in a cooling mode of an air conditioner according to an example embodiment of the present disclosure. FIG. 3 is an exemplary diagram illustrating a connection relationship between a processor and other components according to an example embodiment of the present disclosure. FIG. 4 is a flowchart illustrating a control process of an air conditioner according to an example embodiment of the present disclosure. FIG. 5 is another flowchart illustrating a control process of an air conditioner according to an example embodiment of the present disclosure.

An air conditioner 10 according to an example embodiment of the present disclosure will be described below with reference to FIGS. 1 to 5.

Referring to FIGS. 1 to 5, an air conditioner 10 according to an example embodiment of the present disclosure may include a heat pump 100 including a first heat exchanger 500 and a second heat exchanger 800, a storage unit 200, and a processor 300.

Specifically, the air conditioner 10 according to an example embodiment of the present disclosure may include a first heat exchanger 500 disposed in an indoor space, a second heat exchanger 800 disposed in an outdoor space, a water injection module 810 disposed to be adjacent to the second heat exchanger 800, the water injection module 810 including a flow adjustment valve V adjusting supply of water to the second heat exchanger 800, a fluid tube 400 connected to the first heat exchanger 500 and the second heat exchanger 800, a compressor 600 and an expansion valve 700 disposed on the fluid tube 400, a flow path switching valve 900 changing a path of fluid discharged from the compressor 600 to allow the fluid to flow toward one of the first heat exchanger 500 and the second heat exchanger 800, a processor 300 connected to the flow adjustment valve V and the flow path switching valve 900, and a storage unit 200 connected to the processor 300.

In other words, the heat pump 100 may include the fluid tube 400, the first heat exchanger 500 disposed on the fluid tube 400 and disposed in the indoor space to exchange heat with indoor air, the compressor 600 disposed on the fluid tube 400 to compress fluid, the expansion valve 700 disposed on the fluid tube 400 to depressurize fluid, the second heat exchanger 800 disposed on the fluid tube 400 and disposed in the outdoor space to exchange heat with outdoor air, and the flow path switching valve 900 disposed on the fluid tube 400 to change a flow direction of fluid in the fluid tube 400.

The flow path switching valve 900 may be disposed on the fluid tube 400 to change a flow direction of fluid in the fluid tube 400 depending on a heating mode or a cooling mode.

The flow path switching valve 900, a four-way valve, may be disposed on a downstream side of the compressor 600 to switch a fluid flow direction such that fluid passing through the compressor 600 flows toward the first heat exchanger 500 in the heating mode, and fluid passing through the compressor 600 flows toward the second heat exchanger 800 in the cooling mode. That is, in the heating mode, fluid evaporated by the second heat exchanger 800, operating as the evaporator, may be compressed by the compressor 600, and the compressed high-temperature, high-pressure fluid may be condensed by the first heat exchanger 500, operating as the condenser, such that heat may be discharged to the indoor space, and heating may be performed on the indoor space. In addition, in the cooling mode, fluid may pass through the compressor 600, such that the second heat exchanger 800, operating as the condenser, may discharge heat, and the fluid may pass through the expansion valve 700, such that the first heat exchanger 500, operating as the evaporator, may absorb indoor heat and evaporate the fluid, and cooling may be performed on the indoor space.

In addition, the heat pump 100 may further include a gas-liquid separator 1000 disposed on an upstream side of the compressor 600 in the fluid flow direction in both the cooling mode and the heating mode, and the gas-liquid separator 1000 may serve to filter liquid fluid from fluid introduced into the compressor 600. In other words, the gas-liquid separator 1000 may be disposed on the fluid tube 400 connected between the flow path switching valve 900 and the compressor 600, and the fluid flow direction may be switched by the flow path switching valve 900 to allow the gas-liquid separator 1000 to be positioned on the upstream side of the compressor 600 in both the cooling mode and the heating mode, such that fluid, passing through the gas-liquid separator 1000, may be allowed to flow into the compressor 600, thereby filtering the fluid.

The first heat exchanger 500 may be a general air-cooled heat exchanger.

The second heat exchanger 800 may operate as an evaporative condenser in the cooling mode due to the water injection module 810 disposed to be adjacent to the second heat exchanger 800. The water injection module 810 may include a spraying unit disposed on an upper side or one side of the second heat exchanger 800 to supply coolant toward the second heat exchanger 800, and may include a flow adjustment valve V adjusting supply of water to the second heat exchanger 800. In this case, when the second heat exchanger 800 is operated as the condenser in the cooling mode, the flow adjustment valve V of the water injection module 810 may be opened to perform water injection to the second heat exchanger 800, such that the second heat exchanger 800 may operate as the evaporative condenser. A recovery device (not illustrated) containing cooling water supplied through the water injection module 810 may be further disposed on a lower side of the second heat exchanger 800. When the second heat exchanger 800 operates as the evaporator in the heating mode, an evaporation operation may be performed in an air-cooled manner by the second heat exchanger 800 without water injection of the water injection module 810. That is, when the second heat exchanger 800 operates as the evaporator in the heating mode, the flow adjustment valve V of the water injection module 810 may be closed to serve as an air-cooled evaporator without water injection to the second heat exchanger 800. The second heat exchanger 800 may have a structure having a fin having excellent water spreading properties in the cooling mode.

The second heat exchanger 800, having a structure assisting in cooling of fluid by injecting water onto a surface of the second heat exchanger 800 and evaporating water, may be an evaporative heat exchanger having various forms. As an example, evaporative condensers disclosed in published patent applications, such as KR10-2019-0006781, KR 10-2022-0074734, and KR10-2021-0070921, may be used, but the present disclosure is not limited thereto. The second heat exchanger 800 may more efficiently condense fluid using heat of evaporation through water injection in the cooling mode, thereby effectively improving cooling efficiency. The air conditioner 10 using the heat pump 100 may have efficiently improved cooling performance.

This air conditioner 10 may also include an indoor fan F1 forming a flow of air passing through the first heat exchanger 500, and an outdoor fan F2 forming a flow of air passing through the second heat exchanger 800.

The storage unit 200 may include a program changing the heating mode and cooling mode. Specifically, the program may be a program changing the heating mode in which the flow adjustment valve V is closed such that the first heat exchanger 500 operates as the condenser and the second heat exchanger 800 operates as the evaporator, and the flow path switching valve 900 performs adjustment to allow the fluid from the compressor 600 to flow toward the first heat exchanger 500, and the cooling mode in which the flow adjustment valve V is opened such that the first heat exchanger 500 operates as the evaporator and the second heat exchanger 800 operates as the condenser, and the flow path switching valve 900 performs adjustment to allow the fluid from the compressor 600 to flow toward the second heat exchanger 800.

The processor 300 may be connected to the flow adjustment valve V and the flow path switching valve 900, and may execute a program changing the heating mode and the cooling mode depending on an automatic operation or an input condition of an input unit.

When the processor 300 executes a program to operate the second heat exchanger 800 as the evaporator, the second heat exchanger 800 may serve as an air-cooled evaporator without water injection. In this case, due to a structure of the outdoor evaporator heat exchanger 800 having a relatively small heat exchange area, evaporation efficiency may be insufficient. Accordingly, in order to improve heating efficiency in the heating mode, the processor 300 may be connected to the outdoor fan F2, and the program may be set such that a minimum air volume of the outdoor fan F2 in the heating mode is greater than to a minimum air volume of the outdoor fan F2 in the cooling mode. In other words, the processor 300 may execute a program that is set such that a minimum rotation speed of the outdoor fan F2 in the heating mode is higher than a minimum rotation speed of the outdoor fan F2 in the cooling mode, thereby increasing heat exchange efficiency between outdoor air and the outdoor evaporator heat exchanger 800 to improve heating efficiency of the air conditioner 10.

In addition, the second heat exchanger 800 may be configured to be adjustable in a predetermined angle range relative to a vertical direction. Specifically, the air conditioner 10 may further include a drive motor M connected to the second heat exchanger 800, the drive motor M driven such that the second heat exchanger 800 is adjustable in the predetermined angle range relative to the vertical direction. Accordingly, in the heating mode, the second heat exchanger 800 may be disposed to be inclined at a predetermined angle relative to the vertical direction by driving the drive motor M, such that water, generated by defrosting, may easily escape from the second heat exchanger 800. In addition, during a water injection operation of the water injection module 810 in the cooling mode, the second heat exchanger 800 may be disposed to be inclined at a predetermined angle relative to the vertical direction by driving the drive motor M, such that spreading of water to a surface of the second heat exchanger 800 may be maintained. Accordingly, in each of the cooling mode and the heating mode, the second heat exchanger 800 may be adjusted to an arrangement angle suitable for improving each of cooling efficiency and heating efficiency, thereby further improving cooling efficiency and heating efficiency of the air conditioner 10. Here, arrangement angles of the second heat exchanger 800 adjusted in the heating mode and the cooling mode may be the same or different from each other, but the present disclosure is not particularly limited thereto. In addition, the drive motor is described herein as an example of a drive means being driven such that the second heat exchanger 800 is adjustable in the predetermined angle range relative to the vertical direction, but the present disclosure is not limited thereto, and various drive forms, such as a cylinder and the like, being driven such that the second heat exchanger 800 is adjustable in the predetermined angle range relative to the vertical direction, may be implemented, and will also fall within the scope of the present disclosure. In addition, in the present disclosure, the outdoor evaporative heat exchanger 800 is described as being adjustable in the predetermined angle range, but the present disclosure is not limited thereto. As another example, the second heat exchanger 800 may be disposed to be inclined at a predetermined angle.

According to another example embodiment of the present disclosure, there is provided a method of controlling an air conditioner including the above-described components.

Here, the air conditioner may be the air conditioner described above. Specifically, the air conditioner may include a first heat exchanger 500 disposed in an indoor space, a second heat exchanger 800 disposed in an outdoor space, a water injection module 810 disposed to be adjacent to the second heat exchanger 800 to inject water to the second heat exchanger 800, a fluid tube 400 connected to the first heat exchanger 500 and the second heat exchanger 800, a compressor 600 and an expansion valve 700 disposed on the fluid tube 400, a flow path switching valve 900 changing a path of fluid discharged from the compressor 600 to allow the fluid to flow toward one of the first heat exchanger 500 and the second heat exchanger 800, an indoor fan F1 forming a flow of air passing through the first heat exchanger 500, and an outdoor fan F2 forming a flow of air passing through the second heat exchanger 800. A heat pump may include the fluid tube 400, the first heat exchanger 500 disposed on the fluid tube 400 and disposed in the indoor space to exchange heat with indoor air, the compressor 600 disposed on the fluid tube 400 to compress fluid, the expansion valve 700 disposed on the fluid tube 400 to depressurize fluid, the second heat exchanger 800 disposed on the fluid tube 400 and disposed in the outdoor space to exchange heat with outdoor air, the flow path switching valve 900 disposed on the fluid tube 400 to change a flow direction of fluid in the fluid tube 400, and a gas-liquid separator 1000 disposed on the fluid tube 400. Detailed descriptions of the air conditioner including the above-described components are omitted to avoid duplication.

Referring to FIGS. 4 and 5, in a method of controlling an air conditioner 10 according to another example embodiment of the present disclosure, the air conditioner 10 may be controlled to perform a heating mode or a cooling mode depending on an automatic operation or an input condition of an input unit (S100). Specifically, in the method of controlling the air conditioner 10, the air conditioner 10 may be controlled in the heating mode such that the first heat exchanger 500 operates as a condenser, the second heat exchanger 800 operates as an evaporator without water injection, and fluid from the compressor 600 flows toward the first heat exchanger 500 (S110), or the air conditioner 10 may be controlled in the cooling mode such that the first heat exchanger 500 operates as the evaporator, the second heat exchanger 800 operates as the condenser while injecting water, and the fluid from the compressor 600 flow toward the second heat exchanger 800 (S120).

In addition, in the method of controlling the air conditioner 10 according to another example embodiment of the present disclosure, the air conditioner 10 may be controlled such that a minimum air volume of the outdoor fan F2 in the heating mode is greater than a minimum air volume of the outdoor fan F2 in the cooling mode (S110). In other words, the air conditioner 10 may be controlled such that a minimum rotation speed of the outdoor fan F2 in the heating mode is higher than a minimum rotation speed of the outdoor fan F2 in the cooling mode, thereby increasing heat exchange efficiency between outdoor air and the outdoor evaporator heat exchanger 800 to improve heating efficiency of the air conditioner 10.

In addition, in the method of controlling the air conditioner 10 according to another example embodiment of the present disclosure, when an indoor temperature reaches a target cooling temperature in the cooling mode, an amount of water injected to the second heat exchanger 800 and an air volume of the outdoor fan F2 may be controlled to maintain the target cooling temperature. Accordingly, energy saving and cooling operation optimization may be implemented in the cooling mode.

In addition, in the method of controlling the air conditioner 10 according to another example embodiment of the present disclosure, when an indoor temperature reaches a target heating temperature in the heating mode, an air volume of the outdoor fan F2 may be controlled to maintain the target heating temperature. Accordingly, energy saving and cooling operation optimization may be implemented in the heating mode.

In addition, in the method of the air conditioner 10 according to another example embodiment of the present disclosure, when an outdoor temperature is higher than a preset temperature in the cooling mode, an average flow rate of air passing through the second heat exchanger 800 may be increased. In this case, the average flow rate of air passing through the second heat exchanger 800 in the cooling mode may be controlled to be lower than an average flow rate of air passing through the second heat exchanger 800 in the heating mode. As an example, in the heating mode, the average flow rate of air passing through the second heat exchanger 800 may be controlled to be higher than 1 m/s. In this case, when the outdoor temperature is higher than 30° C. in the cooling mode, the average flow rate of air passing through the second heat exchanger 800 during water injection may be controlled to be 1 m/s or lower. However, settings for the average flow rate of air passing through the second heat exchanger 800 is merely an example to aid understanding of the present disclosure, but the present disclosure is not limited thereto. Depending on an actual situation, the average flow rate of air passing through the second heat exchanger 800 may be appropriately set.

In the heating mode, when low-temperature fluid, introduced through the second heat exchanger 800, exchanges heat with outdoor air in a situation such as low outdoor temperature, heat energy may be not sufficiently absorbed, resulting in frosting or the like in the second heat exchanger 800. Furthermore, lack of temperature rise of the fluid flowing through the second heat exchanger 800 may reduce heating efficiency.

Accordingly, in the method of controlling the air conditioner 10 according to another example embodiment of the present disclosure, in the process of fluid being evaporated while flowing toward the second heat exchanger 800, when frosting occurs in the second heat exchanger 800, a defrost operation may be performed by controlling a flow direction of the fluid such that the fluid flows in an opposite direction to that in the heating mode (S200).

Specifically, in the method of controlling the air conditioner 10 according to another example embodiment of the present disclosure, when frosting occurs in the second heat exchanger 800 in the heating mode, the air conditioner 10 may be controlled such that a defrost mode in which an operation of the outdoor fan F2 is stopped, and the first heat exchanger operates as the evaporator and the second heat exchanger operates as the condenser without water injection is performed for a predetermined period of time (S200).

As a result, in the air conditioner and the method of controlling the same control method according to example embodiments of the present disclosure, heating performance may be ensured using the second heat exchanger 800, and fluid may be more efficiently condensed by the second heat exchanger 800 through water injection in a cooling mode, thereby effectively improving cooling efficiency.

A single second heat exchanger is described above as an example of an outdoor heat exchanger, but the present disclosure is not limited thereto. A plurality of outdoor heat exchangers may be applied, as necessary, and the plurality of outdoor heat exchangers may be arranged in various manners, such as serial arrangement, parallel arrangement, and the like. Not only an evaporative heat exchanger but also a combination of an evaporative heat exchanger and an air-cooled heat exchanger may be used as the plurality of outdoor heat exchangers, as necessary.

While example embodiments have been shown and described above, it will be apparent to those skilled in the art that modifications and variations could be made without departing from the scope of the present disclosure as defined by the appended claims.

What is claimed is:

1. An air conditioner comprising:

a first heat exchanger disposed in an indoor space;

a second heat exchanger disposed in an outdoor space;

a water injection module disposed to be adjacent to the second heat exchanger, the water injection module including a flow adjustment valve adjusting supply of water to the second heat exchanger;

a fluid tube connected to the first heat exchanger and the second heat exchanger;

a compressor and an expansion valve disposed on the fluid tube;

a flow path switching valve changing a path of fluid discharged from the compressor to allow the fluid to flow toward one of the first heat exchanger and the second heat exchanger;

an outdoor fan forming a flow of air passing through the second heat exchanger, the outdoor fan connected to the processor;

a processor connected to the flow adjustment valve and the flow path switching valve; and a storage unit connected to the processor, wherein the storage unit includes a program changing a heating mode in which the flow adjustment valve is closed such that the first heat exchanger operates as a condenser and the second heat exchanger operates as an evaporator, and the flow path switching valve performs adjustment to allow the fluid from the compressor to flow toward the first heat exchanger, and a cooling mode in which the flow adjustment valve is opened such that the first heat exchanger operates as the evaporator and the second heat exchanger operates as the condenser, and the flow path switching valve performs adjustment to allow the fluid from the compressor to flow toward the second heat exchanger, wherein the program is set such that a minimum air volume of the outdoor fan in the heating mode is greater than a minimum air volume of the outdoor fan in the cooling mode.

2. The air conditioner of claim 1, further comprising:

a drive motor connected to the second heat exchanger, the drive motor driven such that the second heat exchanger is adjustable in a predetermined angle range relative to a vertical direction.

3. The air conditioner of claim 1, wherein the second heat exchanger is disposed to be inclined at a predetermined angle relative to a vertical direction.

4. A method of controlling an air conditioner including a first heat exchanger disposed in an indoor space, a second heat exchanger disposed in an outdoor space, a water injection module disposed to be adjacent to the second heat exchanger, the water injection module injecting water to the second heat exchanger, a fluid tube connected to the first heat exchanger and the second heat exchanger, a compressor and an expansion valve disposed on the fluid tube, and a flow path switching valve changing a path of fluid discharged from the compressor to allow the fluid to flow toward one of the first heat exchanger and the second heat exchanger, the method comprising:

controlling the air conditioner, depending on an automatic operation or an input condition of an input unit, to perform a heating mode in which the first heat exchanger operates as a condenser, the second heat exchanger operates as an evaporator without water injection, and fluid from the compressor flows toward the first heat exchanger, or a cooling mode in which the first heat exchanger operates as the evaporator, the second heat exchanger operates as the condenser while injecting water, and the fluid from the compressor flow toward the second heat exchanger, wherein the air conditioner is controlled such that a minimum air volume of an outdoor fan, forming a flow of air passing through the second heat exchanger, in the heating mode, is greater than a minimum air volume of the outdoor fan in the cooling mode.

5. The method of claim 4, wherein, when an indoor temperature reaches a target cooling temperature in the cooling mode, an amount of water injected to the second heat exchanger and an air volume of an outdoor fan, forming a flow of air passing through the second heat exchanger, are controlled to maintain the target cooling temperature.

6. The method of claim 4, wherein, when an indoor temperature reaches a target heating temperature in the heating mode, an air volume of an outdoor fan, forming a flow of air passing through the second heat exchanger, is controlled to maintain the target heating temperature.

7. The method of claim 4, wherein, when an outdoor temperature is higher than a preset temperature in the cooling mode, an average flow rate of air passing through the second heat exchanger is increased and controlled to be lower than an average flow rate of air passing through the second heat exchanger in the heating mode.

8. The method of claim 4, wherein, when frosting occurs in the second heat exchanger in the heating mode, the air conditioner is controlled such that a defrost mode in which an operation of an outdoor fan, forming a flow of air passing through the second heat exchanger, is stopped, and the first heat exchanger operates as the evaporator and the second heat exchanger operates as the condenser without water injection is performed for a predetermined period of time.

* * * * *